US007050885B2

(12) United States Patent
Fiegle et al.

(10) Patent No.: US 7,050,885 B2
(45) Date of Patent: May 23, 2006

(54) PULSE COUNT ACCUMULATOR FOR PULSE COUNT MOTOR CONTROL SYSTEM

(75) Inventors: Richard E. Fiegle, Kokomo, IN (US); James Leo Kohler, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 868 days.

(21) Appl. No.: 10/075,974

(22) Filed: Feb. 15, 2002

(65) Prior Publication Data

US 2003/0155428 A1 Aug. 21, 2003

(51) Int. Cl.
*G05D 23/00* (2006.01)
*H02P 29/00* (2006.01)

(52) U.S. Cl. ..... 700/276; 318/603; 318/548; 701/36

(58) Field of Classification Search ..... 700/276–278, 700/299, 300; 377/1, 2, 82, 15, 16; 701/36; 237/5; 236/1 B, 1 C; 318/546–548, 34, 318/553, 603, 671
See application file for complete search history.

(56) References Cited

U.S. PATENT DOCUMENTS 4,181,939 A * 1/1980 Lyons ..... 378/4
4,382,463 A * 5/1983 Ikebukuro ..... 165/203
4,434,932 A * 3/1984 Hara et al. ..... 236/49.3
4,495,596 A * 1/1985 Sciulli ..... 714/14
4,711,295 A * 12/1987 Sakurai ..... 165/203
4,739,323 A * 4/1988 Miesterfeld et al. ..... 340/825.5
4,800,951 A * 1/1989 Sakurai ..... 165/203
4,856,710 A * 8/1989 Takada et al. ..... 236/13
4,858,677 A * 8/1989 Doi et al. ..... 165/202
5,132,602 A 7/1992 Jorgensen et al.
5,514,977 A 5/1996 Agiman
5,623,416 A * 4/1997 Hocker, III ..... 702/64
5,798,624 A 8/1998 Wilke et al.
6,078,154 A 6/2000 Manlove et al.
6,304,803 B1 * 10/2001 Dao ..... 701/36
6,380,757 B1 4/2002 Draves et al.
6,460,356 B1 * 10/2002 Tao et al. ..... 62/175

* cited by examiner

*Primary Examiner*—Maria N. Von Buhr
(74) *Attorney, Agent, or Firm*—Stefan V. Chmielewski

(57) ABSTRACT

A pulse count accumulator includes a plurality of counters and a communication port. The plurality of counters are each coupled to a different one of a plurality of actuators and a value of each of the counters corresponds to a position of a corresponding one of the plurality of actuators. The communication port is in communication with the plurality of counters and provides the value of each of the plurality of counters to an external device through the communication port.

21 Claims, 3 Drawing Sheets

PULSE COUNT ACCUMULATOR FOR PULSE COUNT MOTOR CONTROL SYSTEM

TECHNICAL FIELD

The present invention is generally directed to a pulse count accumulator and, more specifically, to a pulse count accumulator for a pulse count motor control system.

BACKGROUND OF THE INVENTION

In various systems, e.g., automotive heating, ventilation and air condition (HVAC) systems, it is desirable to track the position of a motor or other actuator. For example, automotive HVAC systems have used a DC motor to position ventilation doors to mix hot and cold air to achieve a desired mixed air temperature and to direct the mixed air to a desired location within a motor vehicle. The generation of accurate motor or actuator position information is desirable to accurately maintain various controlled components, e.g., ventilation doors, at an appropriate position.

In general, automotive HVAC systems have tracked the location of each door with a pulse count system. Typical pulse count systems have included a microcontroller, which has included a number of internal counters that have each been indirectly coupled to an output of an actuator to receive pulses to indicate a door position. Depending upon the degree of rotation of a shaft of the motor, an associated internal counter of the microcontroller is modified an appropriate amount.

Unfortunately, pulse count systems that have used a microcontroller in this manner have experienced an increasing time demand on the microcontroller as the number of actuators in a particular pulse count system have grown. In newer automotive HVAC systems as many as twenty actuators may be utilized within the system, with each actuator providing pulse counts. As more actuators have been utilized in a given HVAC system, it has been proposed that pulse count systems migrate to higher-end microcontrollers, e.g., from an 8-bit microcontroller to a 16-bit microcontroller. Unfortunately, migration to higher-end microcontrollers, if implemented, adds significant additional material cost to the automotive HVAC system.

In a typical automotive pulse count system, pulses may be provided as rapidly as one per millisecond, which has generally required the microcontroller to poll its input lines as often as every five hundred microseconds or use an interrupt to detect the pulses provided to the microcontroller from the various actuators. One solution is to operate the microcontroller of the HVAC system at a higher clock frequency to reduce the actuator associated time demands on the microcontroller. However, in automotive applications the clock frequency of a given microcontroller is normally limited due to electromagnet interference (EMI) considerations. Thus, as the number of actuator outputs continues to grow, the internal counter requirements for a microcontroller of an automotive HVAC system have accordingly increased.

Thus, what is needed is a pulse count system that is practical, economical and capable of handling an increasing number of actuators, as is typical in newer automotive HVAC systems, while operating at frequencies that do not greatly increase EMI considerations.

SUMMARY OF THE INVENTION

The present invention is directed to a pulse count accumulator that includes a plurality of counters and a communication port. According to the present invention, the plurality of counters are each coupled to a different one of a plurality of actuators and a value of each of the counters corresponds to a position of a corresponding one of the plurality of actuators. The communication port is in communication with the plurality of counters and provides the value of each of the plurality of counters to an external device through the communication port.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
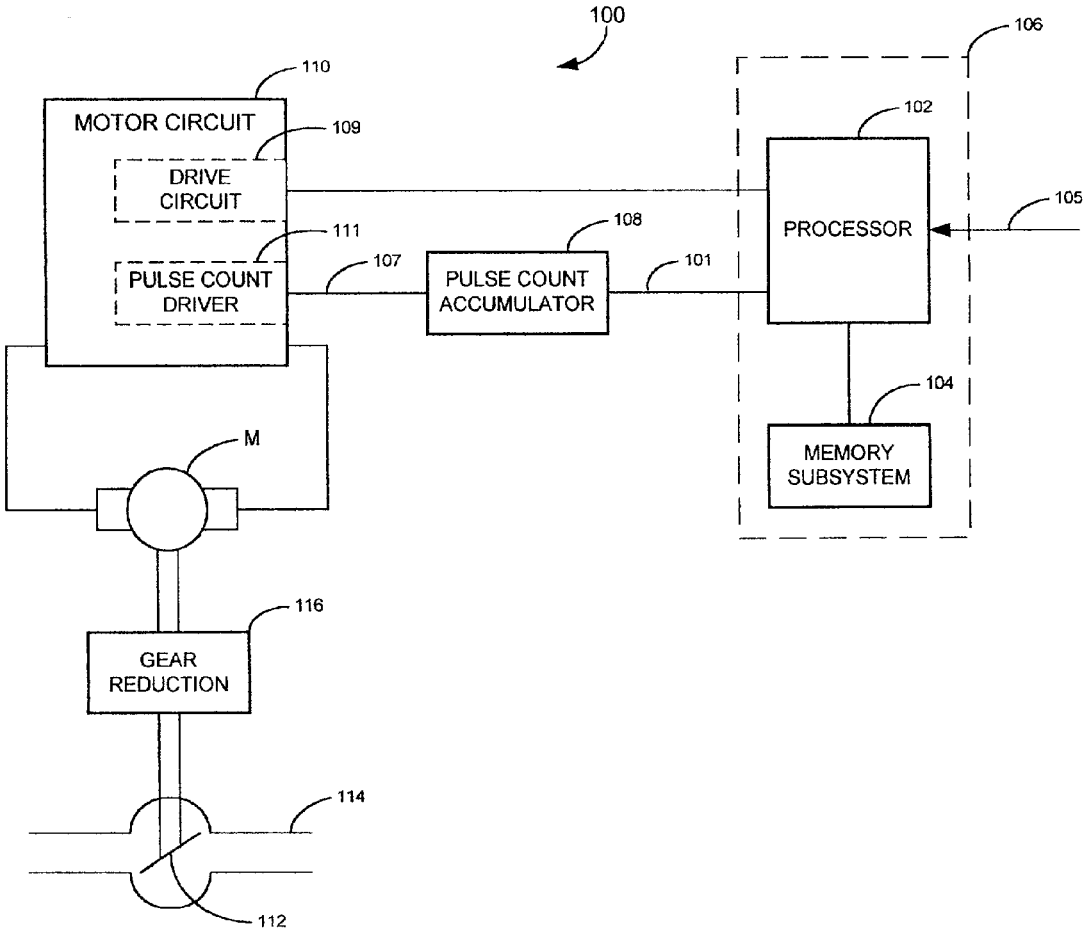
FIG. 1 is an electrical block diagram of an exemplary heating, ventilation and air conditioning (HVAC) system, according to the present invention.

According to the present invention, a pulse count accumulator is disclosed herein that provides a low cost actuator position feedback system, which can be used to replace feedback potentiometers and optical encoders used in many applications. In one embodiment, the pulse count accumulator is implemented within an monolithic integrated circuit, which includes a plurality of counters and a communication port. An input of each of the counters is coupled to a different one of the plurality of actuators and a value of each of the counters corresponds to a position of a corresponding one of the plurality of actuators. The communication port is in communication with the plurality of counters and, in this manner, the value of each of the plurality of counters is provided to an external device through the communication port.

In one embodiment, the external device is a microcontroller and the value of each of the plurality of counters is provided to the microcontroller responsive to a pulse count request. In another embodiment, the communication port is a serial port. In yet another embodiment, the serial port is implemented as a serial peripheral interface (SPI) or an inter-integrated circuit ($I^2C$) interface. In a typical HVAC system, actuators of the system include a DC motor and a gear reduction. The gear reduction typically connects a shaft of the DC motor to another shaft attached to a door that is used to direct air flow. As previously mentioned, doors are used to mix hot and cold air to produce a desired temperature and may also be used to direct mixed air to a desired location (e.g., panel, floor, and/or windshield), as well as control recirculation. The accurate positioning of the doors is desirable for the HVAC system to produce a desired in-car environment. While the discussion herein is primarily directed to automotive HVAC systems, it should be appreciated that the present invention can be directed to virtually any application, including non-automotive applications, that requires the counting of pulses from a plurality of actuators.

In one embodiment, DC motor commutation events are detected by a pulse count driver circuit that includes a one-shot multivibrator that triggers upon detecting a commutation event. The one-shot multivibrator produces, for example, an active low digital pulse of sufficient width to increment a corresponding one of a plurality of counters located within the pulse count accumulator. Advantageously, the pulse count accumulator offloads the burden of keeping track of pulses from the microcontroller. The pulse count accumulator accumulates pulses and upon being queried by the microcontroller, via, for example, a serial interface, transmits the pulse count for each actuator.

Each of the counters of the pulse count accumulator monitor an associated actuator commutation by, for example, incrementing on a falling edge. In one embodiment, the pulse count accumulator includes a reset function that preserves counts during system voltage variations and during initial power-up. In this manner, the task of actually counting pulses is performed by the pulse count accumulator, thus minimizing the load on the microcontroller. In one embodiment, the microcontroller reads the counters of the pulse count accumulator every fifteen milliseconds and subsequently clears the counters. It is desirable to read the counters and then clear the counters so that pulses received simultaneously with a read are not ignored. According to another embodiment of the present invention, the drive to the motor, provided via the microcontroller, is removed during an active pulse.

In one embodiment, a motor circuit includes the pulse count driver (e.g., a filter, a spike detector and a one shot multivibrator) whose output is provided to the pulse count accumulator. In this manner, the pulse count accumulator acts as a buffer between the system microcontroller and the pulse count driver. In an embodiment, eight pulse count drivers are coupled to the pulse count accumulator to provide pulses, which are accumulated and stored by eight 8-bit counters within the pulse count accumulator. As previously mentioned, the count totals from each of the 8-bit counters is transferred to the microcontroller via, for example, an SPI interface. It should be appreciated that the pulse counts may be transferred to the microcontroller via other serial or parallel interfaces.

In one embodiment, the pulse count accumulator includes a serial peripheral interface (SPI) communication port, which includes circuitry to receive a serial clock (SCLK) signal, a serial data in (SDI) signal and a chip select (CS) signal and to provide count data as a serial data out (SDO) signal. In one embodiment, data is clocked out of the pulse count accumulator on a rising edge of the SCLK signal.

Thus, a pulse count accumulator has been generally described which counts pulses from a number of actuators, thus allowing a microcontroller of the system to perform other functions. Advantageously, the pulse count accumulator allows a lower-end microcontroller (e.g., an 8-bit microcontroller) to be utilized instead of a higher-end microcontroller (e.g. a 16-bit microcontroller).

For example, nearly ten percent of microcontroller throughput is utilized by one pulse count motor that provides a pulse every six-hundred microseconds in a typical HVAC system, with a microcontroller that directly counts pulses and runs at four megahertz. Since the HVAC microcontroller is also required to perform communications, implement HVAC algorithms and perform other hardware control, it is desirable for the system throughput to be less than eighty percent. While it is possible to reduce throughput by increasing the clock frequency of the microcontroller, electromagnetic compatibility (EMC) issues become increasingly important at higher frequencies.

FIG. 1 depicts an electrical block diagram of an exemplary automotive heating ventilation and air conditioning (HVAC) system 100, according to an embodiment of the present invention. The system 100 includes a processor 102 that is coupled to a drive circuit 109 of a motor circuit 110, a pulse count accumulator 108 and a memory subsystem 104. The memory subsystem 104 includes an application appropriate amount of volatile and non-volatile memory. It should be appreciated that the processor 102 and the memory subsystem 104 can be incorporated within a microcontroller 106. In response to an input signal on an input 105, the processor 102 provides an appropriate signal to the drive circuit 109 such that a shaft of a motor M is rotated in a proper direction and an appropriate number of partial or complete rotations.

As shown in FIG. 1, the shaft of the motor M is coupled to a gear reduction 116, which is coupled to a door 112, located within an air duct 114. As described above, as the motor M rotates, it provides a series of commutation events to a pulse count driver 111, which provides those counts to the pulse count accumulator 108. Responsive to a command from the processor 102, the pulse count accumulator 108 provides the output of its internal pulse counters to the processor 102. While only one motor M and motor circuit 110 is shown coupled to the pulse count accumulator 108 in FIG. 1, it should be appreciated that the pulse count accumulator 108 is capable of receiving inputs from multiple pulse count drivers (associated with multiple motors and motor circuits). In this manner, the pulse count accumulator 108 receives and stores pulse counts associated with multiple motors and provides those counts to the processor 102 responsive to a count request.

Figure 2:
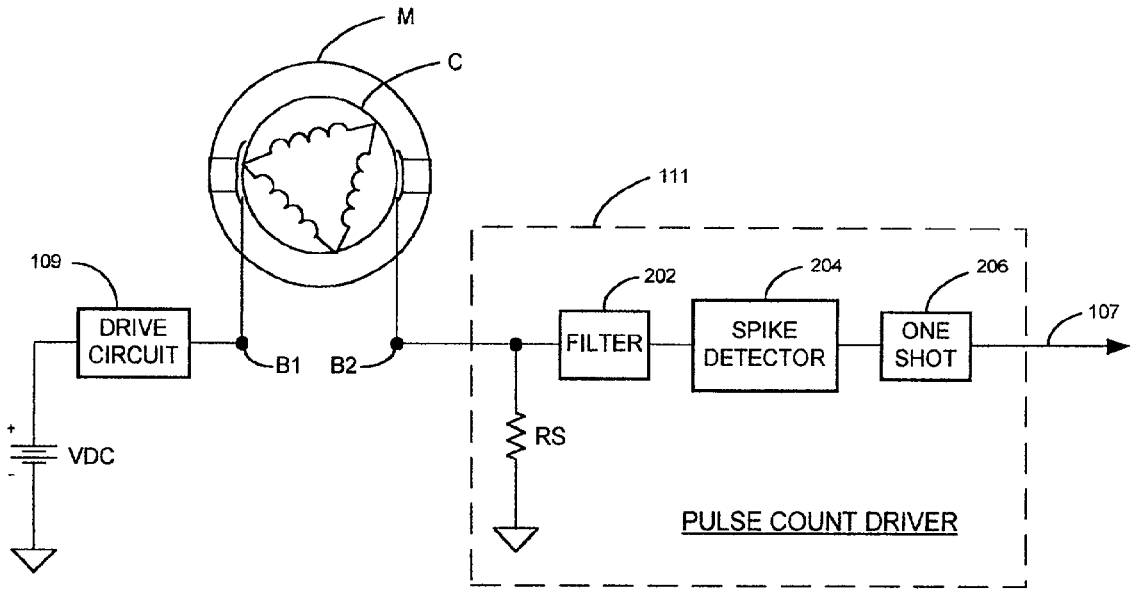
FIG. 2 is an exemplary electrical diagram, in block and schematic form, of a motor circuit and a pulse count driver.

FIG. 2 depicts an exemplary electrical diagram, in block and schematic form, of circuitry for driving the motor M in one direction and circuitry for implementing the pulse count driver 111. It should be appreciated that additional circuitry is required to drive the motor M in an opposite direction. As shown in FIG. 2, a first brush B1 of the motor M is coupled to a DC power supply VDC through the drive circuit 109. A second brush B2 of the motor M is coupled to a filter 202 and to one side of a sense resistor RS. The second side of the resistor RS is coupled to a common ground. As the commutator C rotates responsive to power supplied from the power supply VDC, a series of current pulses are provided across the resistor RS. These pulses are provided to the filter 202, which is coupled to a spike detector 204, which is coupled to a one-shot multivibrator 206. The motor current sensed by the resistor RS is conditioned by the filter circuit 202 and provided to the spike detector 204 and as an output pulse of the one-shot multivibrator 206. The output of the one-shot multivibrator 206 is provided on a signal line 107 to an input of one of the counters of the pulse count accumulator 108.

Figure 3:
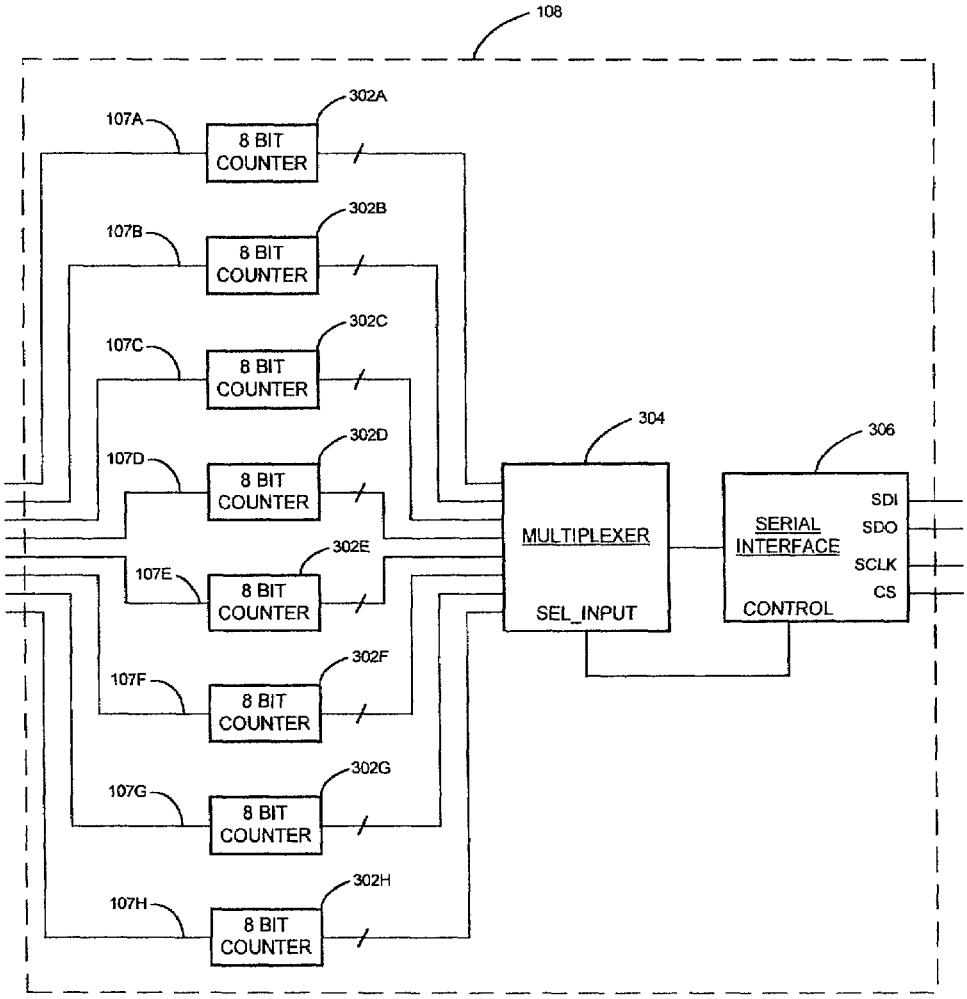
FIG. 3 is an electrical block diagram of a pulse count accumulator, according to an embodiment of the present invention.

As is shown in FIG. 3, according to one embodiment the pulse count accumulator 108 includes eight 8-bit counters 302A–302H. The eight outputs of each of the 8-bit counters 302A–302H are coupled to a multiplexer (e.g., eight 8:1 input muxes whose outputs are each coupled to an input of an 8:1 output mux with associated select logic) 304 that includes a select input that is coupled to a control output of a serial interface 306. The multiplexer 304 selects outputs of an appropriate one of the 8-bit counters 302A–302H responsive to a control signal on its select input SEL_INPUT. The output of the multiplexer 304 is coupled to the serial interface 306, which receives commands from the processor

102, via a serial data in (SDI) input and a chip select (CS) input. The processor 102 also provides a clock signal on a serial clock (SCLK) input and receives serial data (i.e., actuator counts) on the serial data out (SDO) line. As previously discussed, the processor 102 periodically reads the values of the 8-bit counters 302A–302H to determine the positions of the actuators that are coupled to the inputs 107A–107H of the 8 bit counters 302A–302H. In this manner, the system 100 can accurately direct hot and cold air to produce the desired temperature and to direct the air to a desired location and control recirculation.

Accordingly, a pulse count accumulator has been described herein that allows a relatively low-end microcontroller to be utilized. The low-end microcontroller can operate at relatively slow clock frequencies, obviating the need for a more stringent layout to meet EMI considerations. The pulse count accumulator offloads the burden from the HVAC system microcontroller in that the microcontroller is not required to continuously track actuator pulses. As discussed herein, the system accumulates the pulses and upon being queried by the microcontroller transmits the pulse count for each actuator, via, for example, a serial interface.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A pulse count accumulator, comprising:

a plurality of counters, wherein an input of each counter is coupled to a different one of a plurality of actuators, and wherein a value of each of the counters corresponds to a position of a corresponding one of the plurality of actuators; and a communication port in communication with the plurality of counters, wherein the value of each of the plurality of counters is provided to an external device through the communication port.

2. The pulse count accumulator of claim 1, wherein the external device is a microcontroller and the value of each of the plurality of counters is provided to the microcontroller responsive to a pulse count request.

3. The pulse count accumulator of claim 1, wherein the communication port is a serial port.

4. The pulse count accumulator of claim 3, wherein the serial port implements one of a serial peripheral interface (SPI) end an inter-integrated circuit (I2C) interface.

5. The pulse count accumulator of claim 1, wherein each of the plurality of actuators includes a direct current (DC) motor and a gear reduction.

6. The pulse count accumulator of claim 1, wherein each of the plurality of actuators is utilized to position a door in a heating ventilation and air conditioning (HVAC) system to direct air to a desired location and control air recirculation.

7. The pulse count accumulator of claim 1, wherein the plurality of counters are 8-bit counters.

8. The pulse count accumulator of claim, further includes:

a multiplexer coupled between outputs of the plurality of counters and the communication port.

9. A pulse count motor control system, comprising:

a plurality of actuators each including a direct current (DC) motor and a gear reduction; and a pulse count accumulator, including:

a plurality of counters, wherein each counter is coupled to a different one of the plurality of actuators, and wherein a value of each of the counters corresponds to a position of a corresponding one of the plurality of actuators; and a communication port in communication with the plurality of counters, wherein the value of each of the plurality of counters is provided to an external device through the communication port.

10. The system of claim 9, wherein the external device is a microcontroller and the value of each of the plurality of counters is provided to the microcontroller responsive to a pulse count request.

11. The system of claim 9, wherein the communication port is a serial port.

12. The system of claim 11, wherein the serial port implements one of a serial peripheral interface (SPI) and an inter-integrated circuit (12C) interface.

13. The system of claim 9, wherein each of the plurality of actuators is utilized to position a door in a heating ventilation and air conditioning (HVAC) system to direct air to a desired location and control air recirculation.

14. The system of claim 9, wherein the plurality of counters are 8-bit counters.

15. The system of claim 9, further includes:

a multiplexer coupled between outputs of the plurality of counters and the communication port.

16. An automotive heating ventilation and air conditioning (HVAC) system, comprising:

a plurality of actuators each including a direct current (DC) motor and a gear reduction, wherein each of the plurality of actuators is utilized to position a door in the HVAC system; and a pulse count accumulator, including:

a plurality of counters, wherein each counter is coupled to a different one of the plurality of actuators, and wherein a value of each of the counters corresponds to a position of a corresponding one of the plurality of actuators; and a communication port in communication with the plurality of counters, wherein the value of each of the plurality of counters is provided to an external device through the communication port.

17. The system of claim 16, wherein the external device is a microcontroller and the value of each of the plurality of counters is provided to the microcontroller responsive to a pulse count request.

18. The system of claim 16, wherein the communication port is a serial port.

19. The system of claim 18, wherein the serial port implements one of a serial peripheral interface (SPI) and an Inter-integrated circuit (I2C) interface.

20. The system of claim 16, wherein the plurality of counters are 8-bit counters.

21. The system of claim 16, further including:

a multiplexer coupled between outputs of the plurality of counters and the communication port.

* * * * *